US005522097A

United States Patent [19]

Ciccotelli

[11] Patent Number: 5,522,097

[45] Date of Patent: Jun. 4, 1996

[54] CONVERTIBLE COUNTER-COUCH-BED UNIT

[76] Inventor: Anthony J. Ciccotelli, 442 Tournament Dr. #4, Union, N.J. 07083

[21] Appl. No.: 187,070

[22] Filed: Jan. 27, 1994

[51] Int. Cl.[6] ..... A47C 17/04

[52] U.S. Cl. ..... 5/37.1; 5/2.1

[58] Field of Search ..... 5/37.1, 42.1, 2.1, 5/3, 507.1; 297/423.27, 423.78, 423.30; 108/50, 90, 42

[56] References Cited

U.S. PATENT DOCUMENTS

| | | | |
|---|---|---|---|
| 357,530 | 8/1887 | Krause . | |
| 607,293 | 7/1898 | Streit | 5/37.1 |
| 803,341 | 10/1905 | Hoffman | 297/423.30 |
| 870,197 | 11/1907 | Phillipson | 5/42.1 |
| 2,769,987 | 11/1956 | Thal | 5/37.1 |
| 2,856,612 | 10/1958 | Wheeler . | |
| 2,880,426 | 4/1959 | Goldstein | 5/37.1 |
| 3,751,740 | 8/1973 | Belk | 5/37.1 |
| 3,900,905 | 8/1975 | Johnson et al. . | |
| 4,318,195 | 3/1982 | Reppas . | |
| 4,343,508 | 8/1982 | Heling | 5/42.1 |
| 4,506,927 | 3/1985 | Lombardo . | |
| 4,619,005 | 10/1986 | Rutens . | |
| 5,054,139 | 10/1991 | Jones . | |
| 5,136,737 | 8/1992 | Reppas et al. . | |

FOREIGN PATENT DOCUMENTS

| | | | |
|---|---|---|---|
| 486724 | 11/1929 | Germany | 5/42.1 |
| 839548 | 9/1952 | Germany | 5/37.1 |
| 851672 | 10/1952 | Germany | 5/42.1 |
| 333637 | 8/1930 | United Kingdom | 5/42.1 |

*Primary Examiner*—Flemming Saether
*Attorney, Agent, or Firm*—Kenneth P. Glynn

[57] ABSTRACT

A convertible furniture unit has two platforms rotatably joined to each other such that the convertible furniture unit functions as a bed when the two platforms are horizontal and the convertible furniture unit functions as a couch when the two platforms are perpendicular to each other. A removable horizontal surface may be attached to the back of the couch such that a counter-couch is formed.

7 Claims, 3 Drawing Sheets

CONVERTIBLE COUNTER-COUCH-BED UNIT

BACKGROUND OF THE INVENTION

1. Field of the Invention

The present invention relates generally to convertible furniture assemblies and more specifically to a convertible furniture unit which provides a bed, a couch, and a counter. An important optional feature of the present invention is a footrest which also functions as an apparatus for massaging.

2. Information Disclosure Statement

Convertible furniture assemblies have been developed to allow more efficient use of floor space than would be possible by utilizing a separate bed, and couch. The prior art discloses a variety of convertible furniture units. The following information disclosure statement is incorporated into this specification pursuant to Rule 98.

U.S. Pat. No. 357,530 (Krause), issued Feb. 8, 1887, discloses a convertible sofa-bed having a cabinet to conceal a mattress, separate sofa cushions and mattress, and multiple pivot points. A latch secures the convertible furniture unit in the sofa mode. Krause discloses a complex hinge arrangement having two double hinges and one single hinge.

U.S. Pat. No. 2,856,612 (Wheeler), issued Oct. 21, 1958, discloses a convertible furniture unit which can be configured as a cabinet, a sofa, or a bed. The mattress is totally concealed by pivoting said mattress into a cabinet when the furniture unit is used as a cabinet. The mattress is partially concealed in a cabinet when the furniture unit is used as a sofa. Wheeler discloses multiple pivot points, a mattress, and a sofa cushion apart from said mattress.

U.S. Pat. No. 3,900,905 (Johnson), issued Aug. 26, 1975, discloses a convertible sofa-bed. In Johnson, a foldable mattress, preferably of flexible plastic or foam rubber, is stored and concealed in a cabinet or wall enclosure when the furniture assembly functions as a sofa. The mechanism for storing the mattress in the wall enclosure or cabinet consists of wheel assemblies, a guide rail, counterweights, and a hinged box spring. Johnson discloses multiple pivot points and ramps. The ramps secure the wheel assembly thereby securing the seating surfaces of the furniture assembly in the sofa mode.

U.S. Pat. No. 4,318,195 (Reppas '195), issued Mar. 9, 1982, discloses a convertible furniture assembly which is configured as a bed-desk combination or a table-desk combination or a bed-credenza combination. Reppas '195 discloses a cabinet for storing and concealing a mattress and multiple pivot points.

U.S. Pat. No. 4,506,927 (Lombardo), issued Mar. 26, 1985, discloses a convertible table, chair and bed combination, Lombardo discloses a single foldable mattress, three pivot points, two frames with integral legs, and a third flat frame member with legs for a table. Lombardo does not disclose a securing bar and notch or a third flat frame member without legs which is removable.

U.S. Pat. No. 4,619,005 (Rutens), issued Oct. 28, 1986, discloses a combination waterbed, sofa, and sofa-table. The Rutens furniture assembly is composed of a virtually complete, distinct sofa element and bed element in which no bed elements function versatilely as sofa elements. The direction of the sofa may be reversed on the disclosed tongue and grove surface.

U.S. Pat. No. 5,054,139 (Jones), issued Oct. 8, 1991, discloses a combination of a bed with a television set and a structure for concealing the television set within the bed when the television set is not in use. The furniture assembly does not provide a combination of a sofa-bed.

U.S. Pat. No. 5,136,737 (Reppas '737), issued Aug. 11, 1992, is a furniture assembly which is configured as a bed-sofa combination in one embodiment and as a bed-desk combination in another embodiment. Reppas '737 discloses multiple pivot points and complete, distinct sofa and bed elements in which sofa elements do not versatilely function as bed elements.

None of the cited references discloses in combination a convertible furniture unit for use as a bed, sofa, and counter which has a mattress that functions as both a sofa cushion and conventional mattress, one pivot point, and reversibility of the direction the sofa faces via the means for supporting. Moreover, none of the cited references discloses a securing bar and slot for securing the couch in the couch position.

In sum, the convertible shelving assemblies in the prior art frequently employ cumbersome cabinets to disguise a bed when the bed is not in use. For example, Krause is a sofa-bed which conceals and vertically stores a mattress in a cabinet when the sofa-bed is used as a sofa. Similarly, Johnson discloses an upright cabinet for storing a mattress when the convertible furniture unit is used as a lounge. Considerable expense can be involved in manufacturing cabinets for convertible furniture units to achieve the critical tolerances for the mattress to fit into such cabinets.

The warping of cabinet wood over time, the failure of complex mechanisms for concealing the mattress, the deformation of mattress from folding and compressing the mattress are some of the problems associated with known convertible furniture units. In addition, foreign objects such as sheets and pillow cases may become caught in existing convertible furniture units thereby causing difficulty in retrieving the mattress from cabinets and in placing the mattress in the cabinets.

Other prior art references are little more than an aggregation of a complete, distinct sofa and a complete bed. Reppas '737 is an example of a prior art reference which is an aggregation of a sofa and a bed. The convertible furniture unit in the Reppas '737 reference has the disadvantage of being heavy to move and bulkier than if more parts could function versatilely as both a bed and a sofa.

SUMMARY OF THE INVENTION

The object of the present invention is to provide a convertible furniture unit which can be manufactured more economically than the prior art, which is lighter than the prior art and which occupies less volume by utilizing components more versatilely than the prior art.

Another object of the present invention is to provide a combination of article of furniture which is one position is a sofa and which in another position is a bed while taking up a minimum amount of space.

Another object of the present invention is to provide a convertible furniture unit which can be used simultaneously as a sofa and a counter.

Another object of the invention is to provide a couch with storage facilities for materials required to use the couch as a couch, a counter, or a bed.

Another object of the invention is to provide a reversible couch or a bed which can be converted into a couch facing one of two ways with minimal effort.

The present invention eliminates the prior art problems associated with concealing a mattress in a cabinet such as manufacturing a cabinet and a retracting mechanism with the necessary critical tolerances. The present invention discloses no cabinet for concealing a mattress. Rather, the present invention completely utilizes the same mattress when the convertible unit is a bed and when the convertible unit is a couch.

Moreover, the present invention does not duplicate fundamental components to achieve convertibility from a sofa to a bed as does the Reppas '737 prior art reference. Because many components such as the first platform, the second platform, and the mattresses are fully utilized in both the sofa configuration and bed configurations, the present invention will have a lower overall weight than prior art references in which fundamental components are only utilized in solely the bed configuration or solely the sofa configuration.

According to the present invention, the foregoing and other objects and advantages are realized by a convertible furniture unit which has two platforms rotatably joined to each other such that the convertible furniture unit functions as a bed when the two platforms are horizontal and the convertible furniture unit functions as a couch when the two platforms are perpendicular to each other. A removable horizontal surface may be attached to the back of the couch such that a counter-couch is formed.

BRIEF DESCRIPTION OF THE DRAWINGS

The features of the present invention are set forth with particularity in the appended claims. The present invention, together with further objects and advantages of the present invention, may be understood by reference to the following description considered in conjunction with the following accompanying drawings, in which like reference numerals identify like elements.

DETAILED DESCRIPTION OF TEE INVENTION

Generally, the convertible furniture assembly illustrated in the preferred embodiment functions as a bed-sofa-counter combination. The counter can be utilized as a bar, a table, or a desk. The convertible furniture assembly described here can also be used a bookcase or as a storage device. For example, shelves may be added to the preferred embodiment to store miscellaneous household goods. Yet another application of the present invention is a convertible furniture unit which includes an entertainment center to house electronic components such as stereo receivers, televisions and video recorders. The second support frame-footrest can be used independently from the bed-couch-counter combination of the preferred embodiment. In other words, the novel elements encompassed by the second support-frame footrest can be used with a conventional chair, a conventional sofa or any other piece of furniture where a user could benefit from such a footrest. Moreover, different textured fabrics and surfaces may be utilized to provide different massaging sensations for the feet.

Figure 1:
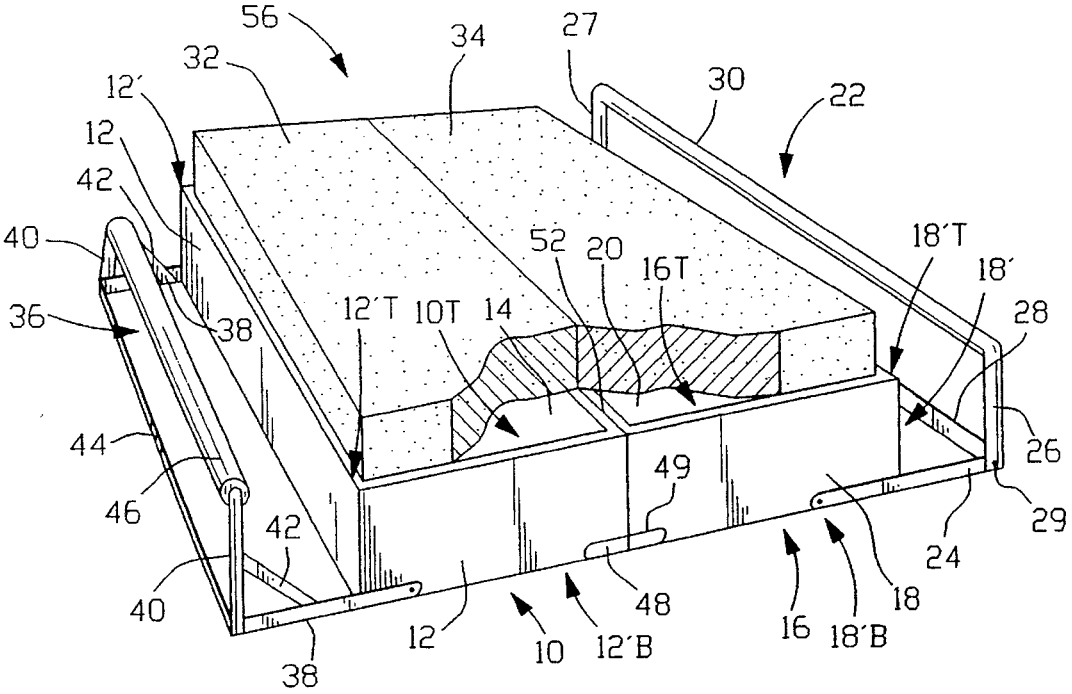
FIG. 1 shows a three-dimensional perspective of the convertible furniture assembly as a bed.
Figure 2:
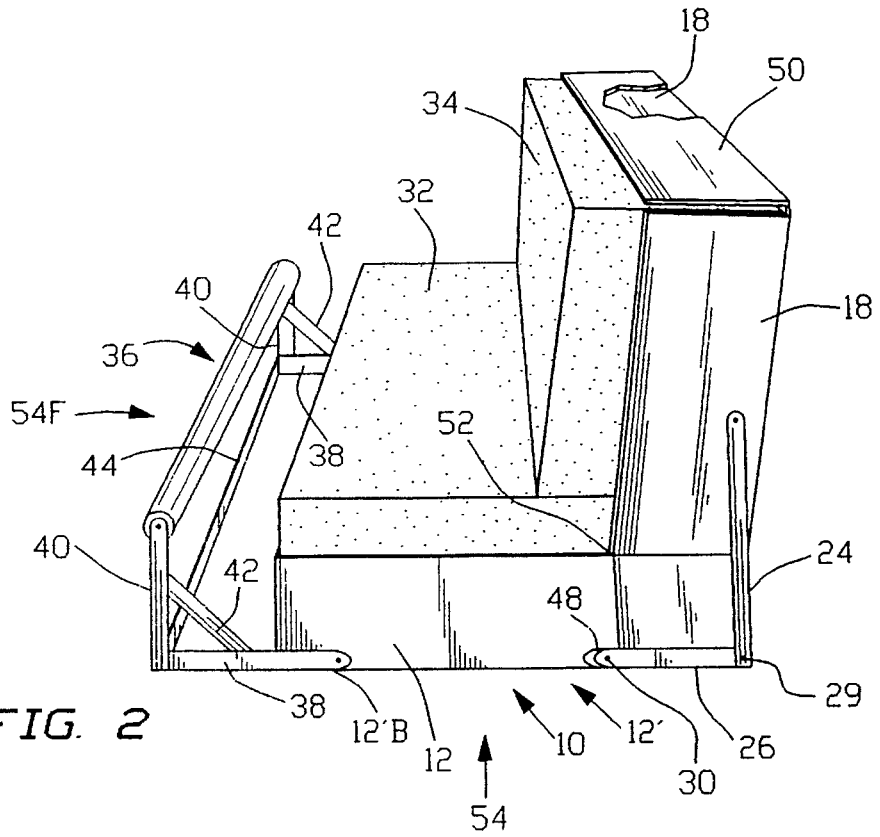
FIG. 2 shows a three-dimensional perspective of the convertible furniture assembly as a couch having a first support frame-footrest attached to a second platform.
Figure 3:
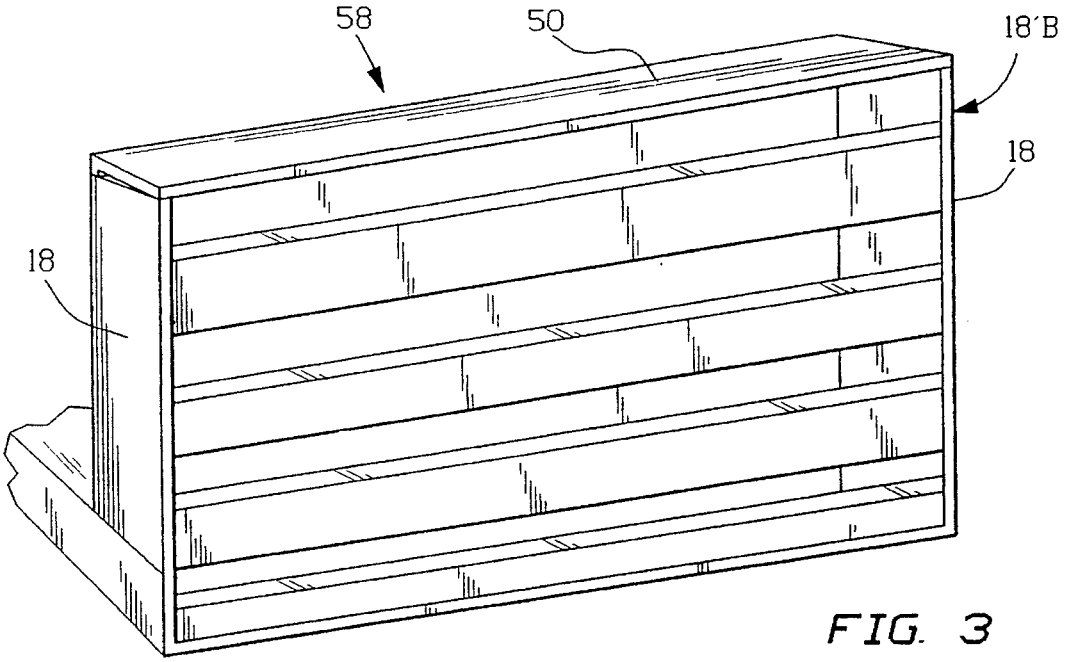
FIG. 3 shows a three dimensional perspective of the convertible furniture assembly as a counter.

Referring to FIG. 1, FIG. 2, and FIG. 3, the main elements of the preferred embodiment of the invention are the first platform 10, the second platform 16, the first support free-footrest 22, the first mattress 32, the second mattress 34, the second support frame-footrest 36, and the horizontal surface 50.

The first platform 10 has a plurality of first members 12, a first polygonal structure 12', and a first surface 14. Each first member 12 is cooperatively affixed to other first members 12 to form a first polygonal structure 12'. The bottom of the first polygonal structure 12'B engages a floor when first platform 10 is in a horizontal position as shown in FIG. 1. The top of the first polygonal structure 12'T is affixed to the first surface 14 via the first members 12 such that the first members 12 are attached substantially perpendicularly to the first surface The second platform 16 has a plurality of second members 18 and a second surface 20. Each second member 18 is cooperatively affixed to other second members 18 to form a second polygonal structure 18'. The bottom of the second polygonal structure 18'B engages the floor when second platform 16 is in a horizontal position as shown in FIG. 1. The top of the second polygonal structure 18'T is affixed to the second surface 20 via the second members 18 such that the second members 18 are substantially perpendicular to the second surface 20.

The second platform 16 and the first platform 10 are rotatably connected by a hinge 52. The hinge 52 is located near the top of the first polygonal structure 12'T and located near the top of the second polygonal structure 18'T. The hinge 52 which extends the length of the first platform 10 or the second platform 16, in the preferred embodiment provides excellent resistance to torsional distortion of the original axis of hinge 52. The first platform 10 and the second platform 16 may be constructed from materials such as wood, plywood, fiberboard, particle board, plastic or fiberglass. The materials may be bonded by adhesives, nails, screws or other fasteners.

Figure 7:
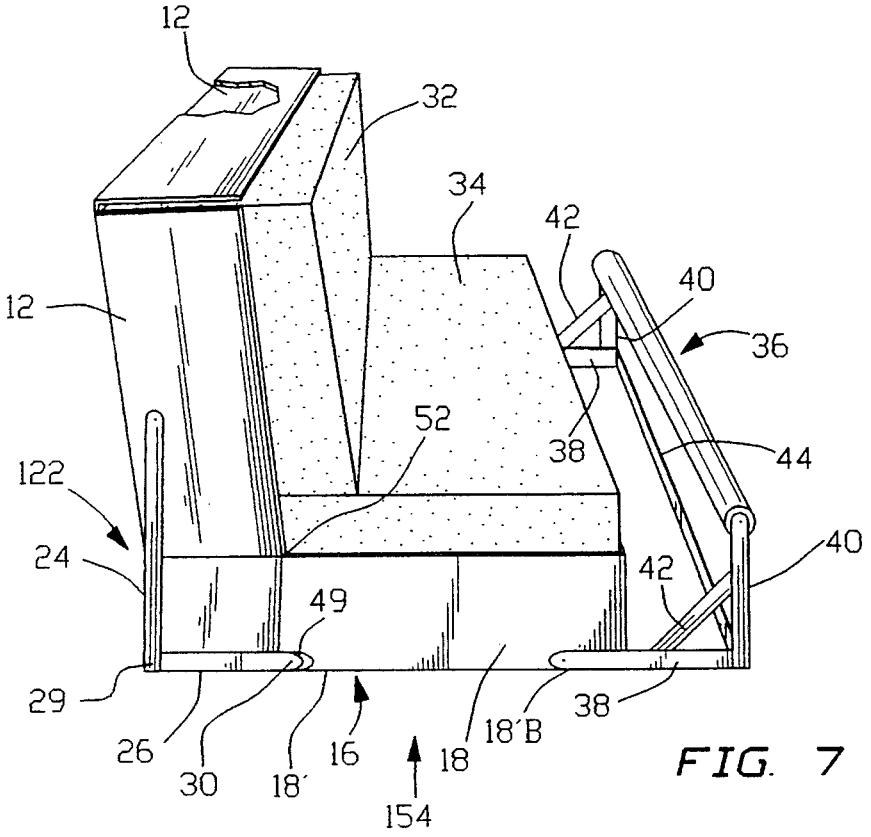
FIG. 7 shows a three-dimensional perspective of the convertible furniture assembly as a couch having the first support frame-footrest attached to a first platform.

As previously stated, one objective of the present invention is to provide a reversible couch capable of facing one of two ways with minimal effort on the part of the user. This is achieved by using first support frame-footrest 22 to support either the first platform 10 or the second platform 16 in a near vertical position when the other platform is in a horizontal position. First support frame-footrest 22 has a plurality of alpha support members 24, a plurality of beta support members 26, one gamma support member 28 and a securing bar 30 as shown. In the preferred embodiment, respective ones of the of the alpha support members 24 are operably attached to corresponding ones of the beta support members 26. The operable attachment of the alpha support member 24 to the beta support member 26 may be accomplished by a bolt or a shaft such as shaft 29 pivotally connecting and capable of locking the alpha support member 24 to the beta support member 26 in a predetermined orientation to one another. Each alpha support member 24 may be removably attached either to the first platform 10 or the second platform 16 near the bottom of the first polygonal structure 12'B as shown in FIG. 7 or near the bottom of the second polygonal structure 18'B as shown in FIG. 2. The securing bar 30 is attached to each beta support member 26 and 27 as shown in FIG. 1 (one end of the securing bar being attached to beta support member 26 and the other end attached to beta support member 27). The securing bar 30 is adapted to mate with a first receiving slot 48 and its counterpart on the opposite side of the first polygonal structure or second receiving slot 49 and its counterpart on the opposite side of the second polygonal structure. Slot 48, as shown, is located in the bottom of the first polygonal structure 12'B. Slot 49 is located in the bottom of the second polygonal structure 18'B as shown.

The means for securing said alpha support member 24 to said first platform 10 or to said second platform 16 includes removable rotatable attachment by hardware such as hinges, bolts, sleeves and shafts. Means for securing the beta support member 26 to said first platform 10 or to said second platform 16 includes the securing bar 30 arrangement of the preferred embodiment. Note that the first support frame-footrest 22 with its pivotal design functions both as a footrest and, alternatively as a means for supporting either the first platform or the second platform, depending on which one is chosen by a user to be placed in a near vertical position to form the backrest of a couch. For example, as shown in FIG. 2, couch 54 is provided when the user chooses to place second platform 16 in a near vertical position forming a backrest for couch 54 while first platform 10 remains in a horizontal position engaging the floor and forming the seat portion of couch 54. Because the support frame-footrest 22 may be removably attached to either the first platform 10 or the second platform 16 via the alpha support members 24, if the user chose to place first platform 10 in a near vertical position while second platform 16 remained in a horizontal position, the couch 154, as shown in FIG. 7 facing the opposite direction would result with no need to rotate the entire convertible furniture assembly. The securing bar 30 could be, but need not be, partially covered with fabric or padding to facilitate functionality as a footrest.

The first mattress 32 and the second mattress 34 may be any conventional commercially available mattresses regardless of whether such mattresses are flexible, deformable or stiff.

The first support frame-footrest 22 provides ample resistance against the torsional forces generated by the weight of the people sitting on the couch 54 and against torsional forces generated by the weight of the first platform 10 when the second platform 16 is in a substantially vertical position. The first support frame-footrest 22 utilizes slot 48 and its counterpart and both ends of securing bar 30 to lock the securing bar 30 in place when the convertible furniture unit is used as a couch 54. The slot 48 and its counterpart uses the weight of the people on the couch 54 and the resistance of a solid floor to generate compressive forces to keep the securing bar 30 locked securely in the slot 48. Note that the alternative embodiment has additional structural features that permit simplified conversion from a bed 56 to a couch 54 or to a counter 58. The alternative embodiment will be discussed near the end of the specification.

Figure 4:
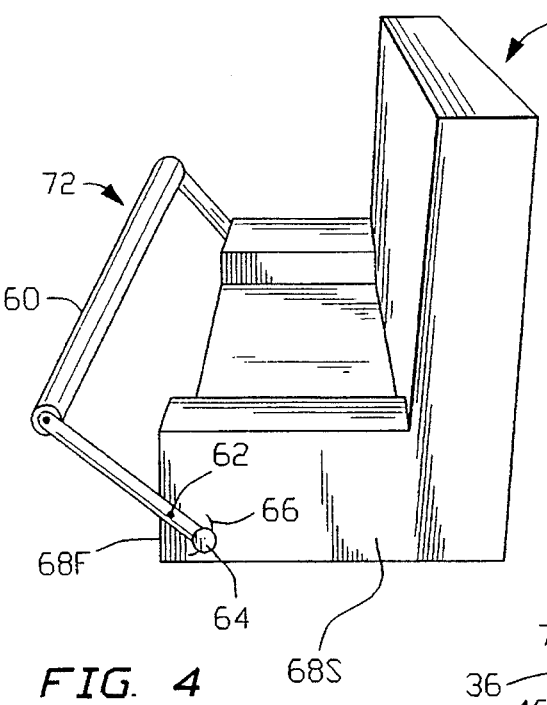
FIG. 4 shows a three-dimensional perspective of a footrest.

The second support frame-footrest 36, as illustrated in FIG. 1, FIG. 2, FIG. 5 and FIG. 7 has a plurality of first footrest members 38, plurality of second footrest members 40, a plurality of third footrest members 42, a fourth footrest member 44 and a cushion 46. Respective ones of the first footrest members 38 are associated with corresponding ones of the second footrest members 40. A third footrest member 42 joins respective ones of the first footrest members 38 to corresponding ones of the second footrest members 40. The third footrest member 42 may be removably attached to the first footrest members 38 and the second footrest members 40. The third footrest member 42 may be rendered unnecessary if the first, footrest member 38 and the second footrest member 40 are joined by mortise and tenon joints or other high-stability joints. The fourth footrest member 44 joins the first footrest members 38. The cushion 46 joins the second footrest members. The second support frame-footrest 36 may be attached to the couch 54 as in the preferred embodiment illustrated in FIG. 2. In the alternative embodiment illustrated in FIG. 5, the second support frame-footrest 36 may encompass a sofa 68. The footrest 72, as illustrated in FIG. 4, also may encompass a sofa 68. A sofa 68 is defined as any generic sofa as opposed to merely pertaining to the couch 54 of the preferred embodiment.

The second support frame-footrest 36 may have a alternate securing bar to engage a slot such that the second support frame-footrest 36 functions analogously to securing bar 30 as a supporting frame for supporting the first platform 10 in a substantially perpendicular position relative to the second platform 16 or for supporting the second platform 16 in a substantially perpendicular position relative to the first platform 10.

The cushion 46 could be disposed about the alternate securing bar.

The horizontal surface 50 may be removably attached or rotatably attached to a particular one of either first members 12 or second members 18 depending on whether first platform 10 or second platform 16 is in a near vertical position. When the horizontal surface 50 is attached to a first member 12 or a second member 18, the horizontal surface 50 is sufficiently stable to be used as a counter 58.

Figure 6:
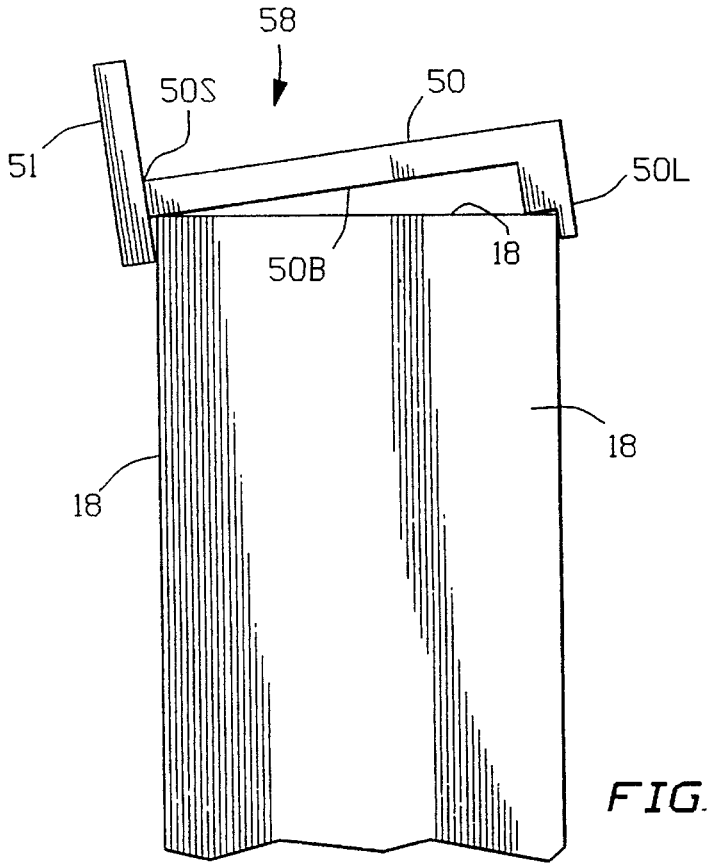
FIG. 6 illustrates the horizontal surface as positioned when used for a counter.

Referring to FIG. 6, the horizontal surface 50 has a lip 50L and a securing panel 51. The lip 50L extends from a bottom of the horizontal surface 50B. The securing panel 51 is near a side of the horizontal surface 50S which is closest to the front of the couch 54 when the convertible furniture assembly is configured as a counter 58. The securing panel 51 and lip 50L bound one first member 12 (not shown) or one second member 18 as shown in FIG. 6 such that the horizontal surface 50 is locked into a position of removable attachment with one first member 12 or one second member 18 respectively depending on which of platform 10 or platform 16 is in a near vertical position.

The present invention is converted from bed 56 to couch 54 (wherein the second platform 16 is used as the back of the couch and the first platform 10 is used as the seating surface) by adhering to the following sequence of steps. First, the first support frame-footrest 22 is removably attached to the second platform 16 via the alpha support members 24. Second, the second platform 16 is elevated and rotated about the axis of the hinge 52 while support frame-footrest 22 is rotated in a direction toward the first platform 10. Finally, the securing bar 30 is slid under the first platform 10 such that the securing bar 30 is aligned with receiving slot 48.

In situations where a couch facing the opposite direction is desired i.e., the couch 154 with the first platform 10 being used as the near vertical back of the couch and the second platform 16 being used as the seating surface, the procedure and resulting configuration are apparent. First support frame-footrest 22 is removably attached to the first platform 10 via the alpha support members 24 and the procedure repeated with securing bar 30 being placed in slot 49.

If the slots 48 and 49 are placed in inner portions of the first polygonal structure 12"B and the second polygonal structure 18'B, respectively, the procedure for converting from bed 56 to couch 54 is as follows: First, the first support frame-footrest 22 is removably attached to the second platform 16 via the alpha support members 24. Second, the second platform 16 is elevated and rotated about the axis of the hinge 52 while support frame-footrest is rotated until securing bar 30 contacts the first platform 10. Third, first platform 30 is elevated and the securing bar 30 is placed under the first platform 10 such that the securing bar 30 is aligned with receiving slot 48. Finally, the first platform 10 is lowered so that the bottom of the first polygonal structure 12'B contacts the floor.

Referring to FIG. 7, there is shown a couch 154 having a first support frame-footrest 122 removable attached to the first platform 10. The first support frame-footrest 122 has the same elements as the first support frame-footrest 22 described in FIG. 2 i.e., the plurality of alpha support members 24, the plurality of beta support members 26, the gamma support member 28 (see FIG. 1) and the support bar 30 (see FIG. 1) and their operation and configuration is the same as that described in FIGS. 1, and 2. In this embodiment, the footrest 36 is removably attached to the second platform 16.

The couch is structured so that the first platform 10 is used as the near vertical back of the couch 154 while the second platform 16 is used as the seating surface. The securing bar 30 is adapted to mate with the slot 49.

The present invention is converted into a couch counter 58 from a couch merely by placing a horizontal surface 50 in alignment with one of the first members 12 or one of the second members 18 depending upon whether the first platform 10 or the second platform 16 is in a substantially vertical position. When the first platform 10 is in a substantially vertical position the horizontal surface 50 is placed in alignment upon one first member 12. When the second platform 16 is in a substantially vertical position, then the horizontal surface 50 is placed in alignment upon one second member 18.

FIG. 4 illustrates the footrest 72. The principle elements of the footrest 72 are the sofa 68, a plurality of first footrest members 38, and a means for massaging a foot 60. The first footrest members 38 are operably connected to the sofa 68 by a pivot point 62, a screw clamp 64, and a footrest slot 66 so that the height of the means for massaging a foot 60 may be adjusted. The means for massaging a foot 60 is operably connected to the first footrest members 38 at substantially perpendicular angles.

Figure 5:
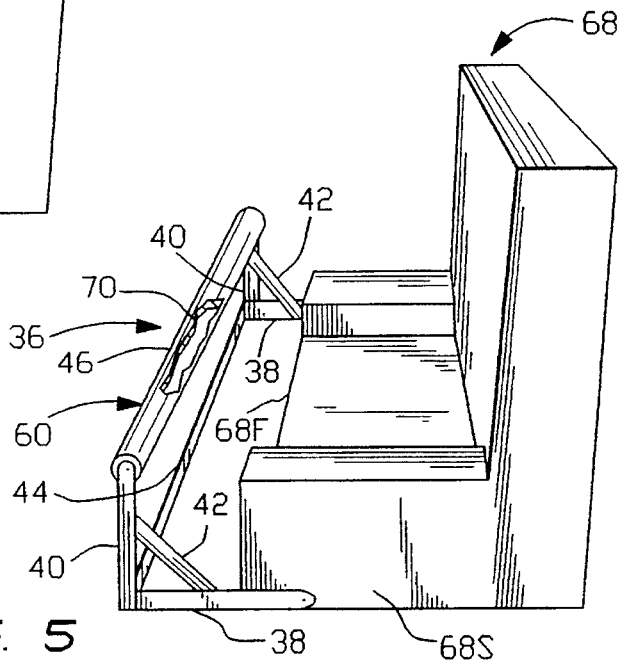
FIG. 5 shows a three-dimensional perspective of an embodiment of the second support frame-footrest including a conventional sofa.

The means for massaging a foot 60 encompasses substantially spherical rollers and a fifth footrest member 70 in one embodiment. Specifically, the substantially spherical rollers are axially and rotatably disposed about a fifth footrest member 70. In another embodiment, as illustrated in FIG. 5, the means for massaging a foot encompasses a cushion 46 and a fifth footrest member 70. The cushion 46 is rotatably and coaxially disposed about the fifth footrest member 70 and the fifth footrest 70 member is affixed to the second footrest member 40. In still another embodiment the means for massaging a foot 60 includes a rough textured surface.

A user receives a comforting massage by placing the bottom of his foot on the second support frame-footrest 36 and rolling the means for massaging a foot 60.

In an alternative embodiment of the second support frame-footrest 36, the first footrest members 38 are operably connected with the second footrest members 40. The first footrest member 38 and the second footrest member 40 are freely rotatable. The first footrest member 38 and the second footrest member 40 may be locked in by a means for locking the second footrest member in a substantially perpendicular position with respect to the second footrest member. The means for locking encompasses a machine bolt with a respective nut, a wood screw or other fasteners.

The alternative embodiment allows either the first support frame-footrest 22 or the second support frame-footrest 36 to function either as a footrest or as the means for supporting the first platform 10 and the second platform 16 respectively. Recall that in the preferred embodiment changing function between a means for supporting and the footrest necessitated removing the first support frame-footrest 22 from the first platform 10 or the second platform 16 and changing the orientation of the first support frame-footrest 22 with respect to the first platform 10 or the second platform 16. The alternative embodiment allows the second support frame-footrest 36 to change function between a means for supporting and a footrest by rotating the second footrest member 40 with respect to the first footrest member 38 thus eliminating the need for removing the first support frame footrest 22 from one platform to the other in order to provide support for which ever platform is in the near vertical position when the invention is configured as a couch.

The preceding detailed description which includes a detailed description of the preferred embodiment and descriptions of alternative embodiments is in no way intended to limit the scope of the claims.

What is claimed is:

1. A convertible furniture unit comprising:

a) a first platform, said first platform having a plurality of first members and a first surface, wherein each first member is cooperatively affixed to other first members so as to form a first polygonal structure with a top and a bottom, each first member attached perpendicularly to said first surface at said top of said first polygonal structure;

b) a second platform, adjacent to said first platform and rotatably attached thereto by a hinge, said second platform having a plurality of second members and a second surface, wherein each second member is cooperatively affixed to other second members so as to form a second polygonal structure with a top and a bottom, each second member attached perpendicularly to said second surface at said top of said second polygonal structure, said hinge located near said top of said first polygonal structure and said top of said second polygonal structure;

c) a first pair of receiving slots located in said bottom of said first polygonal structure;

d) a second pair of receiving slots located in said bottom of said second polygonal structure;

e) means comprising a first support frame-footrest for supporting one of said first platform in a near vertical position with said second platform in a horizontal position and said second platform in a near vertical position with said first platform in a horizontal position; wherein said means for supporting includes:

i) a plurality of alpha support members, each alpha support member being removably attached to one of said first platform and said second platform;

ii) a plurality of beta support members, respective ones of said beta support members operably attached to corresponding ones of said alpha support members such that respective ones of said beta support members may rotate to different orientations with respect to corresponding ones of said alpha support members;

iii) means for locking respective ones of the beta support members in different orientations with respect to the corresponding ones of the alpha support members; and iv) a securing bar, the securing bar affixed to said beta support members,the securing bar having a shape adapted to engage one of said first pair of receiving slots and said second pair of receiving slots;

and, f) a horizontal rectangular counter surface, having top, a bottom and sides, said horizontal counter surface removably connected to one of said first platform and said second platform via one of said first members and said second members when one of said first platform and second platform is in said near vertical position and the other of said first platform and said second platform is in said horizontal position.

2. The convertible furniture unit of claim 1 wherein said first support frame-footrest is rotatably and removably affixed to one of said first platform and said second platform.

3. The convertible furniture unit of claim 1 further comprising two mattresses, a first mattress removably placed upon said first surface, and a second mattress removably placed upon said second surface.

4. The convertible furniture unit of claim 1 further comprising a second support frame-footrest, said second support frame-footrest affixed to one of said first platform and said second platform, said affixed to platform being different from said platform supported by said first support frame-footrest.

5. A convertible furniture unit as recited in claim 4 wherein said second support frame-footrest further comprises:

a) a first footrest member;

b) a second footrest member, the second footrest member being attached substantially perpendicularly to the first footrest member; and c) a cushion, the cushion being attached to the second footrest member such that the cushion forms a substantially horizontal area suitable for resting a foot.

6. A convertible furniture unit as recited in claim 4 wherein said second support frame-footrest comprises:

a) a plurality of first footrest members;

b) a plurality of second footrest members, respective ones of the first footrest member being operably attached to corresponding ones of the second footrest members such that corresponding ones of the second footrest members may rotate to different orientations with respect to respective ones of the first footrest members;

c) means for locking corresponding ones of the second footrest members in different orientations with respect to respective ones of the first footrest members;

d) a cushion, a cushion being attached to the second footrest member such that the cushion forms a substantially horizontal area suitable for resting a foot; and, e) an alternate securing bar, the alternate securing bar being affixed to the second footrest member, the alternate securing bar having a shape adapted to engage a slot, the slot located in a bottom of any one selected from the group of the first platform and the second platform.

7. The convertible furniture unit of claim 1 wherein said horizontal counter surface has a lip and a securing panel, both perpendicular to said top and said bottom of said horizontal counter surface, said securing panel running along and extending above and below one of said sides of said horizontal counter surface, said lip extending from said bottom of said horizontal counter surface at the opposite side of said securing panel, said lip and said securing panel removably covering one of said first members when said first platform is near vertical, and said lip and said securing panel removably covering one of the second members when the second platform is near vertical.

* * * * *